United States Patent [19]

Capostagno et al.

[11] 4,313,154

[45] Jan. 26, 1982

[54] LIGHTING FIXTURE WITH UNIFORM MOUNTING FRAME FOR NEW INSTALLATIONS

[75] Inventors: Joseph A. Capostagno, Somerset, Mass.; Kingsley Chan, Rutherford; Alexandre Kartavenko, Bayonne, both of N.J.

[73] Assignee: Lightolier Incorporated, Jersey City, N.J.

[21] Appl. No.: 147,852

[22] Filed: May 8, 1980

[51] Int. Cl.[3] ..... F21S 1/06

[52] U.S. Cl. ..... 362/365; 362/147; 362/404; 362/408

[58] Field of Search ..... 362/147, 365, 404, 408

[56] References Cited

U.S. PATENT DOCUMENTS 4,175,281 11/1979 Lonseth ..... 362/147

*Primary Examiner*—Stephen J. Lechert, Jr.

*Attorney, Agent, or Firm*—Arthur B. Colvin

[57] ABSTRACT

The present invention is directed to a universal ceiling lighting fixture and more particularly is directed to a lighting fixture adapted to be mounted above a ceiling made of gypsum board, acoustical tile or the like, the fixture being characterized by its ability to support reflectors of a variety of diameters. More particularly, the fixture includes novel mounting means which extend over the reflector receiving aperture, the mounting means being adjustable in accordance with the diameter of the reflector intended to be used with the fixture.

7 Claims, 9 Drawing Figures

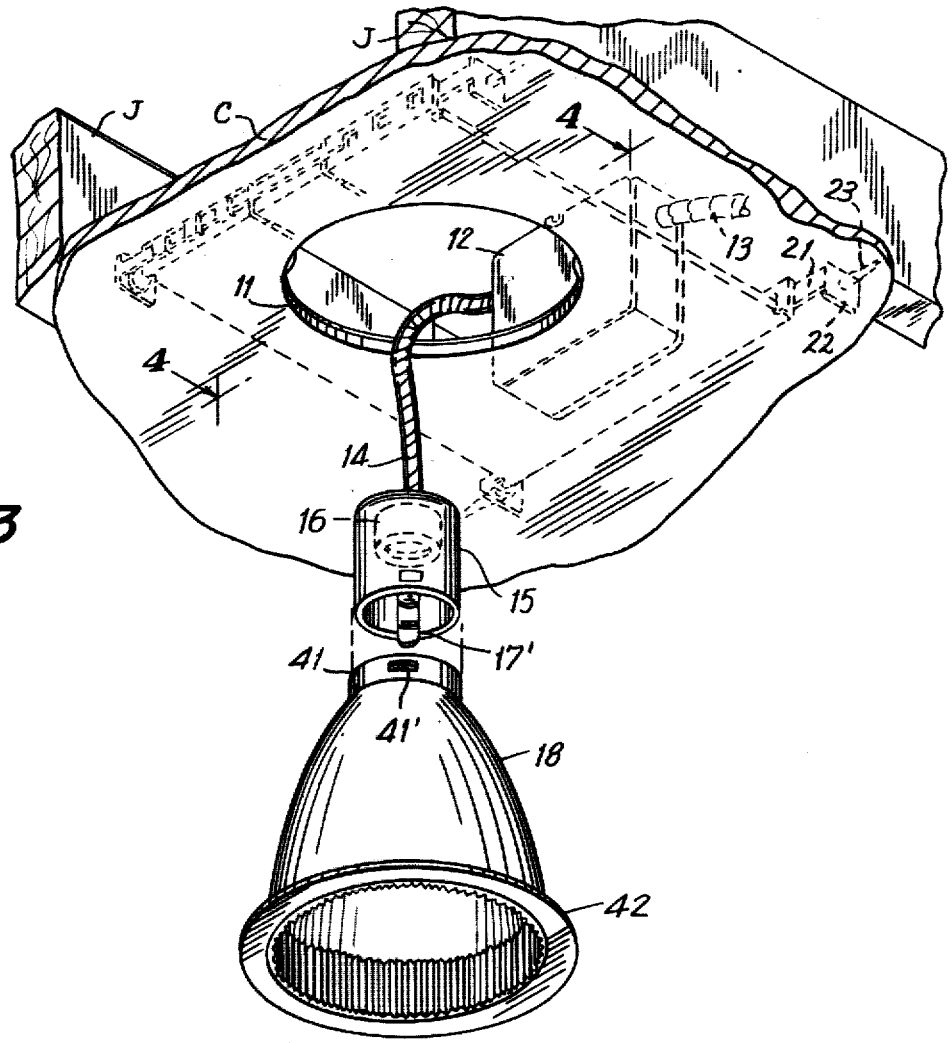
FIG. 3
FIG. 4
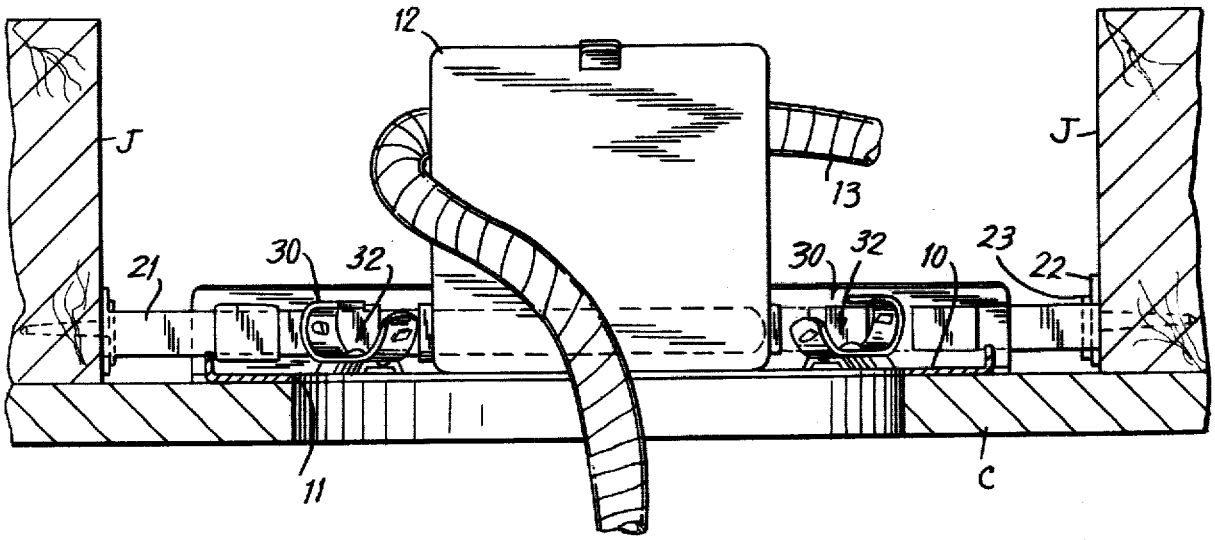

LIGHTING FIXTURE WITH UNIFORM MOUNTING FRAME FOR NEW INSTALLATIONS

BACKGROUND OF THE INVENTION

1. Field of the Invention

The present invention is in the field of lighting fixtures and especially lighting fixtures intended to be mounted to a ceiling support structure. More particularly, the present invention is in the field of ceiling fixtures intended to be mounted between joists or secured to the gridwork supporting a hung ceiling installation.

2. The Prior Art

Conventional ceiling lighting fixtures whether mounted between joists in a wood construction or to a ceiling hanging grid comprise in essence a mounting frame structurally secured above the ceiling, a junction box carried by the mounting frame and connected to the electrical supply source and a conduit extending from the junction box and connected with the bulb housing. Typically the bulb housing in addition to the usual bulb receiver socket incorporates means for connection to a reflector assembly.

In the normal installation procedure, the frame is mounted in registry with an aperture in the ceiling and the bulb housing connected to the junction box passed outwardly through the aperture. Thereafter, a reflector member is attached to the bulb housing. The reflector member conventionally employs a flange or bezel which extend radially outwardly from the lower terminal end of the reflector, the size of the flange or bezel being such as to outwardly lap the aperture formed in the ceiling so as to conceal any irregularities resulting from the ceiling cutting procedure and present a finished appearance.

In order to provide for the varying lighting patterns and appearances sought by end users, it is conventional for fixture manufacturers to supply a plurality of different reflector members. By way of example where a broad lighting pattern is sought, the reflector may be relatively shallow tapering abruptly from the broad base toward the apex. On the other hand, where concentrated light patterns are sought in the area immediately beneath the fixture, the reflector will normally be substantially taller with a relatively slow taper from the base to the apex.

The differing shapes of reflectors with their consequent variations in external diameter have presented problems by way of interaction with the fixture in the sense that the conventional means for supporting the reflector to the fixture have had to be varied in each instance in accordance with the diameter of the reflector to be supported. This has, in the past, required distributors to stock a variety of different fixture subassemblies in accordance with the configuration of the reflector intended to be used in each instance.

SUMMARY OF THE INVENTION

The present invention may be summarized as directed to a universal ceiling fixture adapted to be mounted above a ceiling and readily adjusted to accommodate reflectors of a wide variety of configurations. More particularly, the present invention relates to a ceiling lighting fixture which comprises a frame defining an opening, the frame being adapted to be mounted directly above a ceiling. The frame includes a plurality of resilient reflector support members which in the mounted position project inwardly over the opening in the frame through which the reflector is to be passed. The mounting members may be resiliently deflected outwardly to accommodate a first variety of reflectors within a given size range. To make the apparatus adaptable for a wider variety of reflectors, the spring retainer members are pivotally mounted and incorporate at least two separate sets of reflector retainer fingers. The fingers of one set project a first radial distance over the opening in the frame. The fingers of the second set project a different radial distance over the frame. Detent means are provided for selectively adjusting the mounting means so that either the first or the second set of fingers are disposed in partial registering relation to the opening in the frame in accordance with the size of the reflector intended to be used.

It is accordingly an object of the invention to provide an improved lighting fixture device for use in ceiling installations characterized in that the same may be readily adjusted to accept reflectors of a wide range of sizes. A further object of the invention is the provision of a lighting fixture of the type described which is adapted to securely hold the external surfaces of reflectors of a variety of shape-wise configurations. Still a further object of the invention is the provision of a lighting fixture including a frame having an opening formed therethrough means for supporting the frame above a ceiling installation and a plurality of mounting devices arranged at angularly spaced apart positions surrounding the opening, the devices being selectively shiftable into variable extending position over the opening to accommodate reflectors of a variety of sizes and in addition being shiftable to a neutral position whereby they are removed from registry with the opening, thus permitting the opening in the frame to be used as a template for accurately cutting the hole in the ceiling without interference by the reflector mounting means. In contrast to conventional structures which typically include a down-turned flange surrounding the reflector receiving opening, the undersurface of the instant device is flat, allowing the hole in the ceiling to be cut after the ceiling material is positioned.

The above objects and such other and further objects as may appear herein or be hereinafter set forth, will be more fully understood in conjunction with a description of the accompanying drawings in which:

FIG. 3 is a perspective view of ceiling fixture mounted in position but prior to assembly of the reflector and bulb housing;

FIG. 4 is a section taken on line 4—4 of FIG. 3;

Figure 1:
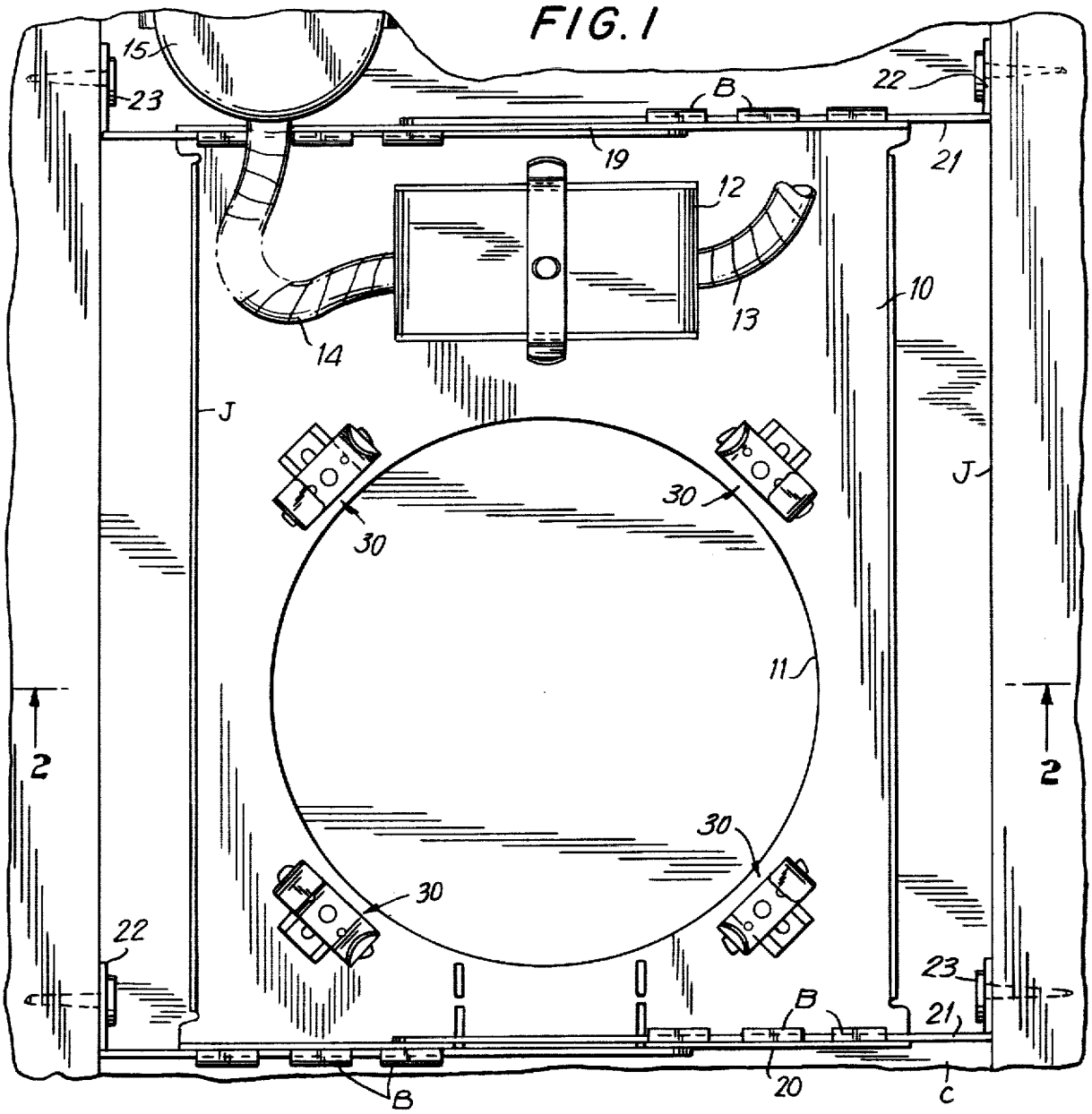
FIG. 1 is a top plan view of a fixture in accordance with the invention mounted in ceiling supporting framework in advance of formation of the aperture in the ceiling.
Figure 2:
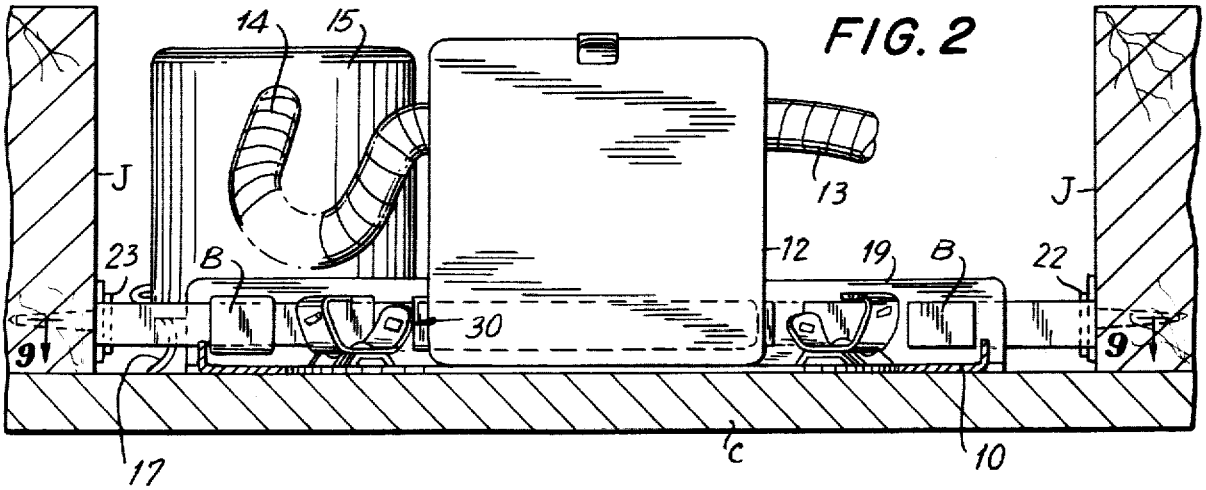
FIG. 2 is a vertical section taken on line 2—2 of FIG. 1.
Figure 5:
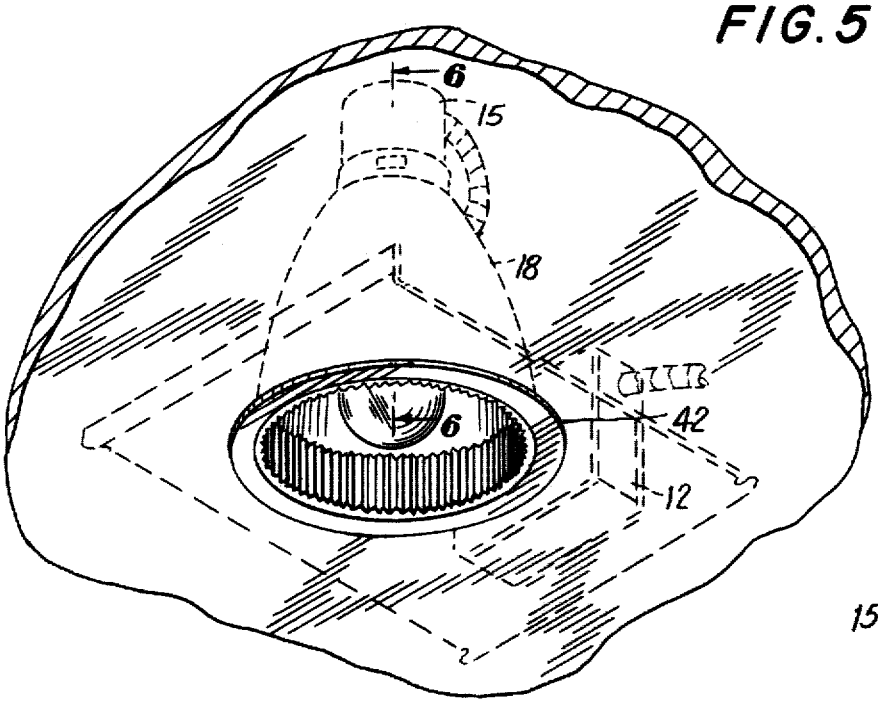
FIG. 5 is a perspective view partly in phantom showing the assembled lighting fixture.

Referring now particularly to FIG. 1, the fixture includes a mounting frame or plate 10 having a centrally located reflector receiving aperture 11 formed therein. A junction box 12 is fixed to the frame 10 and includes a first conduit component 13 adapted to be connected to the main electrical supply and a second conduit component 14 which carries at its distal end bulb housing 15. The housing 15 includes the usual bulb socket 16 for receiving an incandescent bulb. Additionally, the housing 15 includes a spring mounting assembly 17 conventional in nature for connection to the reflector assembly 18.

Figure 9:
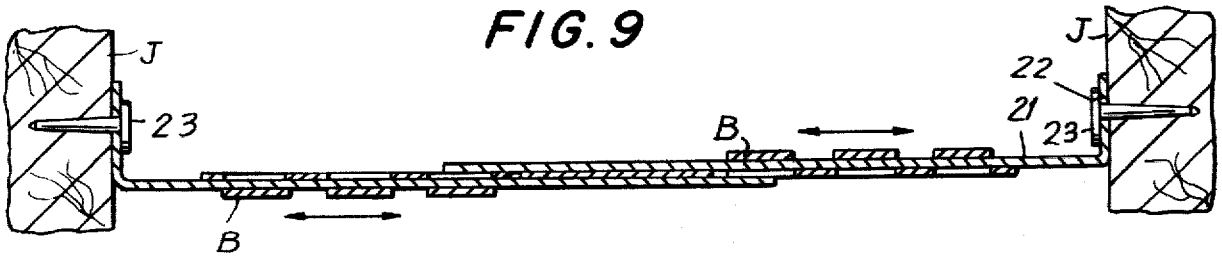
FIG. 9 is a horizontal section taken on line 9—9 of FIG. 2.

The mounting frame includes essentially conventional structure enabling the same to be fixed between joists J or alternatively to the gridwork of a hung ceiling installation (not shown). The fixture support structure which forms no part of the present invention is provided by a pair side webs 19, 20 formed by upwardly folded edges of the plate or fixture mounting frame 10. The webs 19, 20 include on their opposite faces a plurality of spaced bracket members B (see FIG. 9) formed integrally with or secured to the webs 19, 20. The brackets members B which are spaced from the webs provide guideways for laterally directed support bars 21 which are slideably disposed between the brackets and the respective webs. As will be readily appreciated, the frame 10 is mounted by sliding the support bars 21 outwardly until the end portions 22 thereof abut against the joists J following which fastener members 23 such as nails driven through the ends 22 securely mount the frame at a desired position. Normally, where the ceiling member C will be fixed to the downwardly directed faces of the joists J, the frame or plate 10 should be mounted such that is undersurface is flush with the undersurface of the joists.

Figure 7:
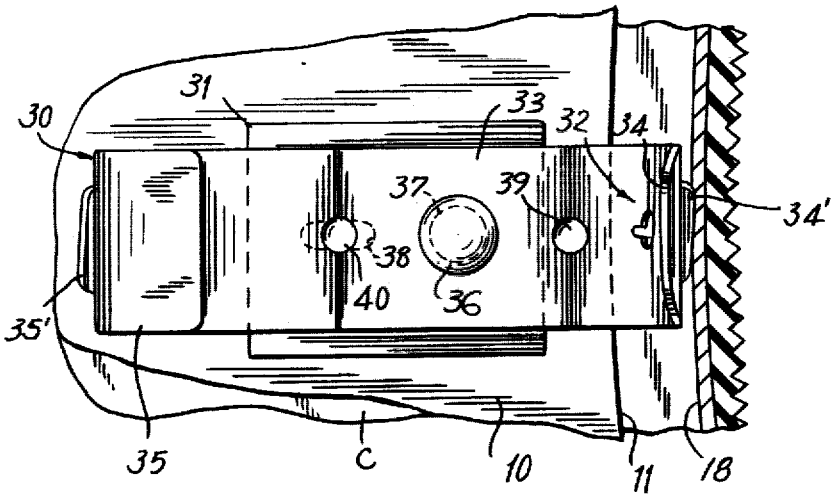
FIG. 7 is a further magnified horizontal section taken on line 7—7 of FIG. 6.
Figure 8:
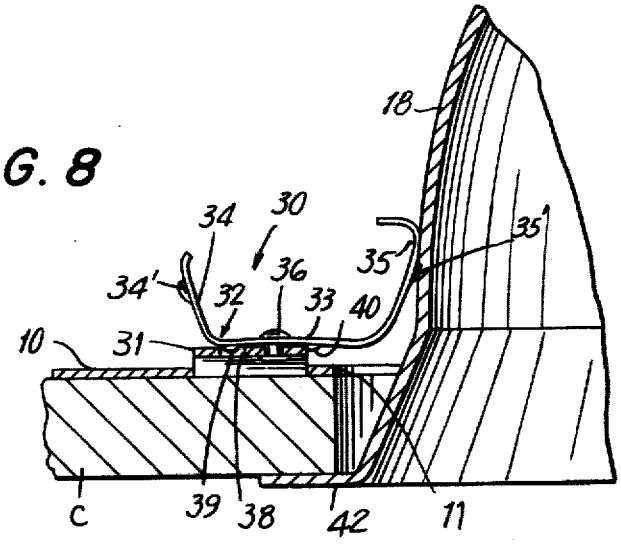
FIG. 8 is a fragmentary vertical sectional view, similar to the view of FIG. 6 showing the reflector mounting mechanism engaged with a reflector of different size than that shown in FIG. 6.

The lighting fixture is provided with novel mounting assemblies 30 which form the principal advance of the present invention. As best seen in FIGS. 7 and 8, the mounting assemblies include base portions 31, struck upwardly from the metal of the plate or frame 10. In the illustrated embodiment, there are four such mounting assemblies 30, spaced angularly apart approximately 90° about the circumference of the reflector receiver aperture 11. Obviously however, more or less such assemblies may be employed. The mounting assemblies include a generally U-shaped connector member 32 formed of resilient metallic material, the connector member including a base or branch 33 and generally vertically directed legs 34, 35 extending from the sides of the branch. The branch 33 is rotatably secured to the base 31 by a vertically directed rivet member 36, passing through the base 31 and through an aperture 37 formed in the branch 33. The base 31 includes a detent aperture 38 which aperture cooperates with detents 39 or 40 to retain the connector member in one of two relatively rotated positions 180° apart. Preferably, the branch 33 of the connector member is slightly bowed so as to exhibit in the unstressed condition a slight concavity on its undersurface, whereby the rivet member 36 flattens the bowed configuration and assures that the detent 39 or 40 will be firmly seated within the aperture 38.

The connector arms 34, 35 as best seen in FIG. 8, diverge slightly in an upward direction. Each of the arms 34, 35 includes an outwardly deflected inclined gripping tooth 34', 35' respectively for engagement with the external surface of the metal reflector member 18. The tooth portions 34', 35' are angularly inclined not merely in the radial direction but also in a lateral direction as more fully set forth in U.S. Pat. No. 4,039,822. As noted in said U.S. Patent, the lateral inclination of the teeth enables the reflector after mounting to be readily demounted by a combined downward and rotary movement.

Figure 6:
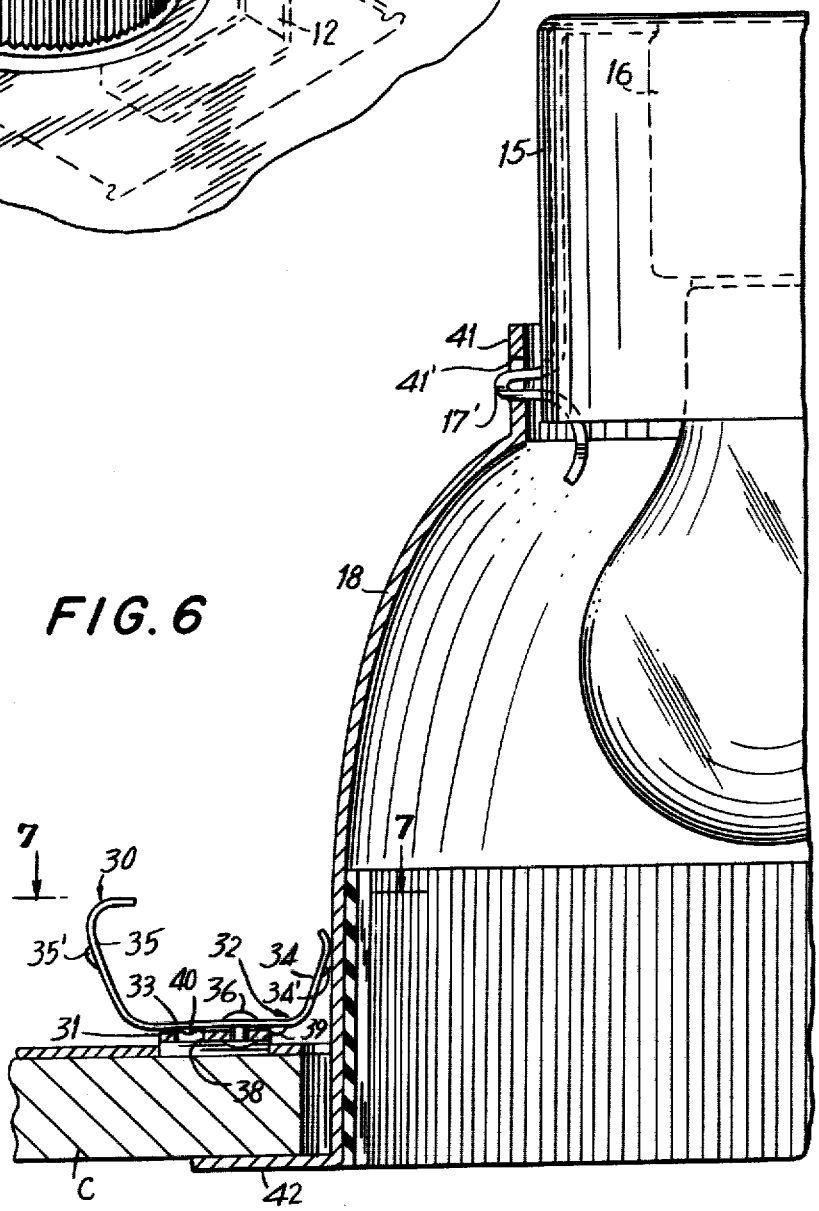
FIG. 6 is a vertical section on a magnified scale taken on line 6—6 of FIG. 5.

As will be evident from an inspection of FIG. 8, the rivet 36 intersects the base 33 at a non-central position thereon. That is to say that the arm 34 is closer to the pivot axis of the rivet 36 than is the arm 35. Due to the eccentric nature of the mounting of the branch 33, it will be observed that when the leg 35 is rotated to its innermost radial position shown in FIG. 8, the said leg will project inwardly over the aperture 11 to a greater extent than when the leg 34 is rotated to its innermost position (see FIG. 6).

A further feature of the invention lies in the fact that the mounted fixture may function as a template to assist the formation of an aperture in the ceiling which registers with the aperture 11 of the fixture. Where the template forming function of the fixture is to be employed the connector members 32 are rotated to their neutral position as shown in FIG. 1 at which position no part of the members overlie the aperture 11. With the parts thus oriented and assuming the fixture to be mounted and a blank or unpunctured ceiling disposed below the fixture, it is merely necessary to drill a small hole in the ceiling at a position in registry with any portion of the aperture 11. Thereafter, a keyhole saw is passed through the drilled aperture and the saw is operated to effect a cutting using the inner periphery of the aperture 11 as a guide. Obviously, the fixture may be employed with a ceiling having precut apertures.

The operation and installation of the device will be apparent from the preceding discussion. The frame member 10 is first mounted between joists in a manner previously set forth. The hole in the ceiling is either preformed or cut using the aperture 11 as a template in the manner noted. Thereafter, the bulb housing 15 is removed to a position below the ceiling through the aligned aperture 11 and aperture cut in the ceiling (see FIG. 3). The reflector member 18 is next connected to the housing 15 by inwardly deflecting the connector spring members 17, sleeving the neck 41 of the reflector over the lower end of the housing 15 and releasing the latch portions 17' when they are in alignment with complimental slots 41' in the neck.

With the reflector member thus assembled to the light bulb housing, the connector member 32 is rotated to bring the appropriate leg 34 or 35 into registry with the aperture 11. The selection of leg 34 or 35 will be dependent upon the external diameter of the reflector. When the connector members are approximately positioned, it is merely necessary to press the reflector upwardly until the radially directed flange 42 thereof outwardly laps the aperture formed in the ceiling. The reflector may be demounted from its assembled position by a combined downward and rotary movement imparted to the reflector as more fully described in the above referenced U.S. Pat. No. 4,039,822.

From the foregoing, it will be readily recognized that there is described in accordance with the present invention a lighting fixture device adapted to accept any of a variety of reflector members of different diameters in accordance with the selected position of adjustable connector members. While the connector members in accordance with the illustrated embodiment incorporate two arms located 180° apart, it will be readily understood that three or more arms might be provided where a greater range of adjustment is required.

Skilled workers familiarized with the present disclosure will readily understand that numerous variations may be made from the constructional details illustrated, and accordingly the invention is to be broadly construed within the scope of the appended claims. For instance, while a conical reflector is shown, the device may be provided with a rectangular aperture and be used to support a reflector which is rectangular in section.

We claim:

1. A universal ceiling lighting fixture for supporting reflectors of a variety of sizes comprising a frame, means on said frame for securing the same above a ceiling structure, a reflector receiver aperture formed in said frame, a plurality of adjustable reflector mounting assemblies on said frame in angularly offset positions surrounding and adjacent said aperture, each said mounting assembly comprising a pivot member extending normal to said frame and spaced from the edge of said aperture by a first distance, and a connector member rotatably mounted on said pivot means, said connector member including at least two connector arms having distal end portions spaced from said pivot member by second and third distances, respectively, both said second and third distances having a horizontal component greater than said first distance, selected said arms being adapted to be disposed in registry with said aperture, and gripper means on said distal ends of said arms for engaging and supporting side portions of a reflector.

2. A fixture in accordance with claim 1 and including detent means interposed between said connector members and said frame for adjustably locking said connector members in at least two selected rotated positions relative to said pivot members, thereby to position selected ones of said arms in registry with said aperture.

3. A fixture in accordance with claim 2 and including a reflector member generally conical in configuration, the outer side wall portions of said reflector member being engaged and supported at a selected heightwise position by said gripper means.

4. A fixture in accordance with claim 2 wherein said connector members are generally U-shaped, each said member including a horizontally disposed central branch eccentrically mounted on a said pivot member, said connector arms extending vertically upwardly from the extremities of said central branches.

5. A fixture in accordance with claim 4 wherein said connector members are formed of resilient metallic material.

6. A universal ceiling lighting fixture comprising a frame having a reflector receiver aperture, means on said frame for securing the same above a ceiling structure, a plurality of adjustable reflector mounting assemblies fixed to said frame in angularly offset positions surrounding said aperture, each said mounting assembly including at least one reflector gripper portion and a plurality of extension means for selectively supporting said gripper portion in partially overlapping position of said aperture, said extension means being of different lengths whereby the spacing between said gripper portions may be adjusted in accordance with the size of the reflector to be supported between said gripper portions in said fixture.

7. A lighting fixture in accordance with claim 6 wherein each said mounting assembly includes a pivot member fixed to said frame and said extension means is mounted on said pivot member and includes first and second gripper portions, said gripper portions being spaced disparate distances from said pivot member.

* * * * *